US006736620B2

(12) United States Patent
Satoh

(10) Patent No.: US 6,736,620 B2
(45) Date of Patent: May 18, 2004

(54) SCROLL-TYPE FLUID MACHINE HAVING AT LEAST ONE INLET OR OUTLET OF A PLURALITY ABLE TO BE CLOSED BY A CLOSURE MEMBER

(75) Inventor: Tohru Satoh, Yokohama (JP)

(73) Assignee: Anest Iwata Corporation (JP)

( * ) Notice: Subject to any disclaimer, the term of this patent is extended or adjusted under 35 U.S.C. 154(b) by 0 days.

(21) Appl. No.: 10/371,407

(22) Filed: Sep. 26, 2002

(65) Prior Publication Data

US 2003/0161747 A1 Aug. 28, 2003

(30) Foreign Application Priority Data

Sep. 27, 2001 (JP) ..... 2001-296402

(51) Int. Cl.[7] ..... F01C 1/04; F01C 11/00

(52) U.S. Cl. ..... 418/6; 418/15; 418/39; 418/55.2

(58) Field of Search ..... 418/5, 6, 15, 39, 418/55.1, 55.2

(56) References Cited

U.S. PATENT DOCUMENTS 4,141,677 A * 2/1979 Weaver et al. ..... 418/6
5,582,511 A * 12/1996 Fairbanks ..... 418/15
6,050,792 A * 4/2000 Shaffer ..... 418/15

FOREIGN PATENT DOCUMENTS

EP 0113786 * 7/1984 ..... 418/55.1
JP 2971652 8/1999

* cited by examiner

*Primary Examiner*—John J. Vrablik

(57) ABSTRACT

A scroll fluid machine comprises a stationary scroll that has a spiral stationary wrap, and an orbiting scroll that has a spiral orbiting wrap to form a compression chamber between the stationary and orbiting wraps. In the stationary and orbiting wraps, an outer low-pressure pressurizing portion is separated from an inner high-pressure pressurizing portion. A plurality of outlets and inlets are formed in the low-pressure and high-pressure pressurizing portions respectively. At least one of the outlets or at least one of inlets is selectively closed.

2 Claims, 5 Drawing Sheets

SCROLL-TYPE FLUID MACHINE HAVING AT LEAST ONE INLET OR OUTLET OF A PLURALITY ABLE TO BE CLOSED BY A CLOSURE MEMBER

BACKGROUND OF THE INVENTION

The present invention relates to a scroll-type fluid machine suitable in use for an air compressor, a vacuum pump and an expansion machine.

A known scroll-type fluid machine is disclosed in Japanese Patent No. 2,971,652.

The fluid machine comprises an orbiting scroll that is connected to a drive shaft rotated by an AC electric motor to be able to revolve and has a spiral orbiting wrap on one side surface, a stationary scroll that faces the orbiting scroll and has a stationary wrap to form a compression chamber between the stationary and orbiting wraps, and tip seals that seals the compression chamber at the ends of the stationary wraps of the stationary scroll to be in sliding contact with the surface of the orbiting scroll.

For example, if the scroll compressor set by frequency of 50 Hz for East Japan is used in West Japan, the tip seal is made to be shorter not to seal the winding finish of the stationary wrap. Therefore, even if the number of rotation of the AC electric motor becomes higher by the frequency of 60 Hz for West Japan, it prevents the scroll-type fluid machine not to be subject to overload operation. That is, the length of the tip seal can be changed depending on the frequency of AC voltage applied to the AC electric motor.

However, in the known scroll-type fluid machine as above, it is necessary to change the length of the tip seal depending on the condition of use, and thus, various types of tip seals having different lengths have to be provided. Thus, it is impossible to use the same type of tip seals, thereby increasing cost. To replace the tip seal, it is necessary to remove other parts to involve troublesome replacement.

SUMMARY OF THE INVENTION

In view of the disadvantages as above, it is an object of the present invention to provide a scroll-type fluid machine that need not replacement of parts even if condition in use is different, to prevent overload.

BRIEF DESCRIPTION OF THE DRAWINGS

The features and advantages of the present invention will become more apparent from the following description with respect to embodiments as shown in appended drawings wherein.

DETAILED DESCRIPTION OF THE PREFERRED EMBODIMENTS

Figure 1:
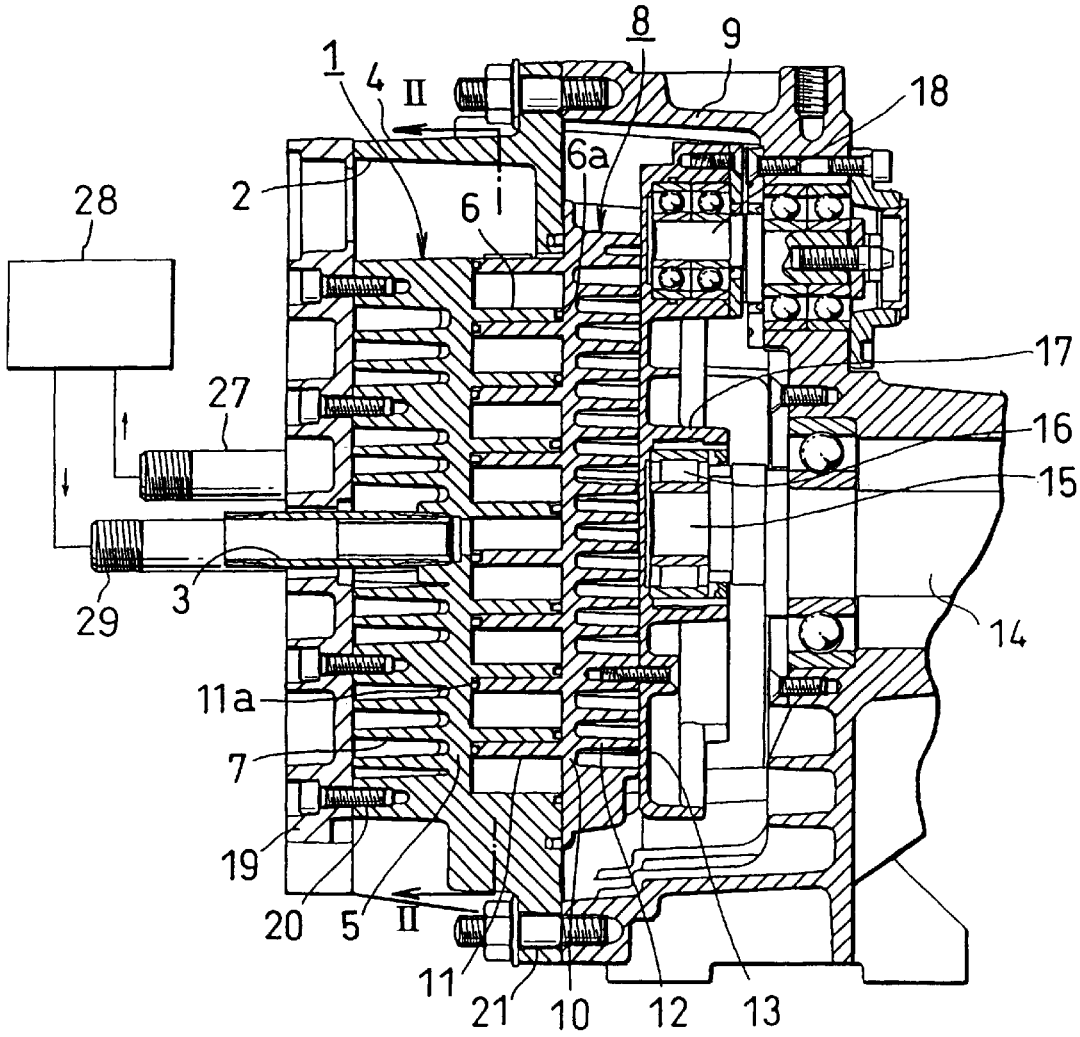
FIG. 1 is a vertical side sectional view of one embodiment of a scroll compressor according to the present invention.

A stationary scroll 1 has a stationary end plate 5 that has a spiral stationary wrap 6 on the front surface (right side in FIG. 1) and a plurality of equally-spaced cooling fins 7 on the rear surface. The stationary end plate 5 is integrally formed with a housing 4 that has an inlet 2 at the outer portion and an outlet 3 at the center. The outlet 3 is connected to an external air tank via a conduit. (not shown) A tip seal 6*a* is provided at the end of the stationary wrap 6 and is in sliding contact with the front surface of an orbiting end plate 10.

An orbiting scroll 8 faces the front surface of the stationary scroll 1 and has a circular orbiting end plate 10. The orbiting end plate 10 has a spiral orbiting wrap 11 on the front surface which faces the stationary scroll 1, and a plurality of equal-height cooling fins 12 that are equally spaced. A tip seal 11*a* is provided on the end of the orbiting wrap 11 and is in sliding contact with the front surface of the stationary end plate 5.

A bearing plate 13 is fixed on the rear surface of the orbiting scroll 8 or opposite surface to the orbiting wrap 11. On the middle of the bearing plate 13, a tubular boss 17 is projected to support an eccentric shaft 15 of a drive shaft 14 via a bearing 16. On the outer portion of the bearing plate 13, there are three crank-pin-type rotation prevention mechanisms 18 so that the orbiting scroll may revolve with respect to the housing 9.

Figure 2:
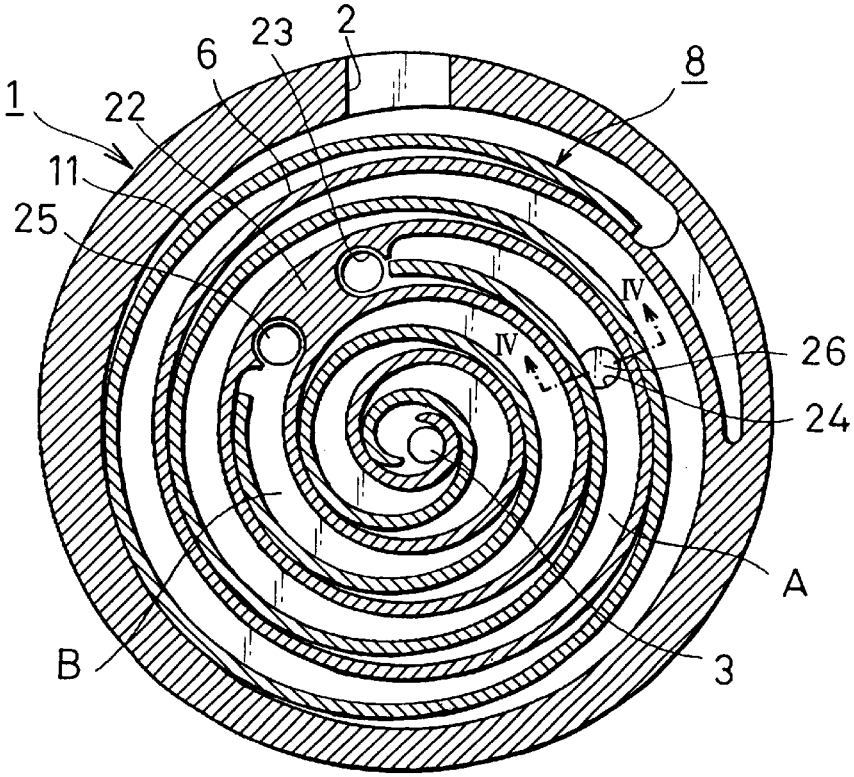
FIG. 2 is a vertical sectional view taken along the line 11—11 in FIG. 1.
Figure 3:
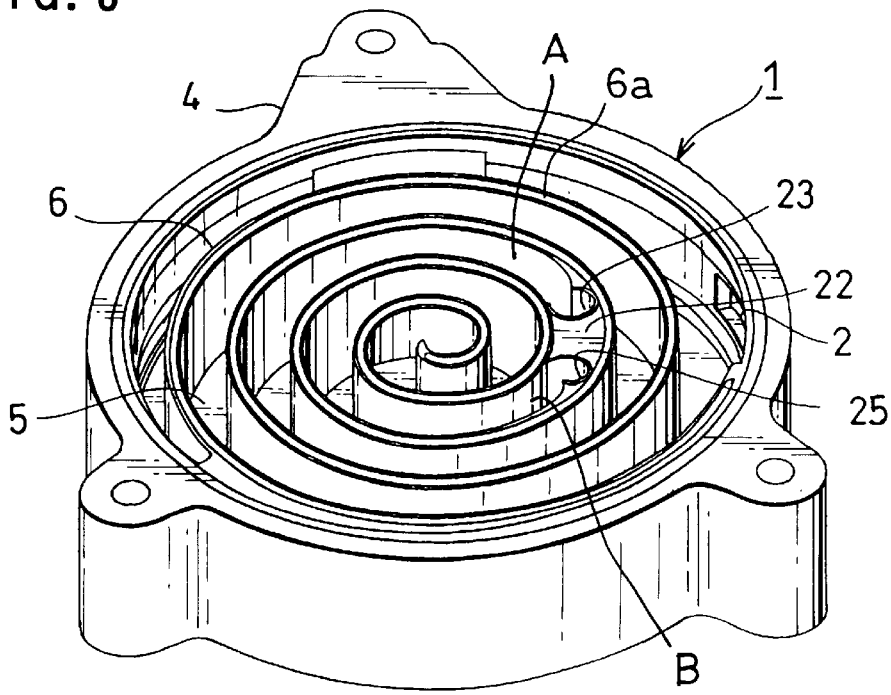
FIG. 3 is a perspective view of a stationary scroll in FIG. 1, seen from the front or stationary wrap.

Between the stationary scroll 1 and the orbiting scroll 8, the center of the orbiting scroll 8 is eccentric to the center of the stationary scroll 1 and the drive shaft 14 by a distance corresponding to the eccentricity of the eccentric shaft 15 so that the orbiting wrap 11 of the orbiting scroll 8 may be engaged with the stationary wrap 6 of the stationary scroll 1 as shown in FIG. 2.

A pressing plate 19 is engaged on the rear surface of the stationary scroll 1 and fastened by fastening screws 20, and the rear surface of the orbiting scroll 8 is engaged on the front surface of the bearing plate 13 and fastened by fastening screws 21 to construct a scroll compressor.

The drive shaft 14 is connected to a motor (not shown) outside the housing via a pulley and a V-shaped belt or directly connected to a motor (not shown) in the housing 9 so as to rotate in a predetermined direction by the motor.

In the scroll compressor, there are a low-pressure pressurizing portion "A" in which winding of the stationary wrap 6 is finished outside the stationary scroll 1 and the orbiting scroll 8; and a high-pressure pressurizing portion "B" in which winding of the stationary wrap 6 begins inside the scrolls 1 and 8. The low-pressure pressurizing portion "A" and the high-pressure pressurizing portion "B" are divided by an insulating wall 22 of the stationary wrap 6 to block a fluid path of a pressurized gas.

The stationary end plate 5 includes first and second low-pressure-side outlets 23, 24 which communicate with the low-pressure pressurizing portion "A" of the stationary wrap 6 and penetrate axially; and a high-pressure inlet 25 which communicates with the high-pressure pressurizing portion "B" of the stationary wrap 6 and penetrates axially.

The first low-pressure-side outlet 23 is formed by the insulating wall 22 at the innermost winding of the low-pressure pressurizing portion "A", and the second low-pressure-side outlet 24 is formed at outer portion than the first low-pressure outlet 23.

Figure 4:
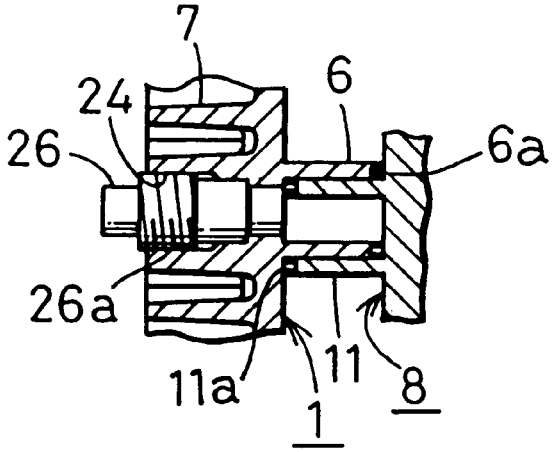
FIG. 4 is a vertical sectional view taken along the line IV—IV in FIG. 2.
Figure 5:
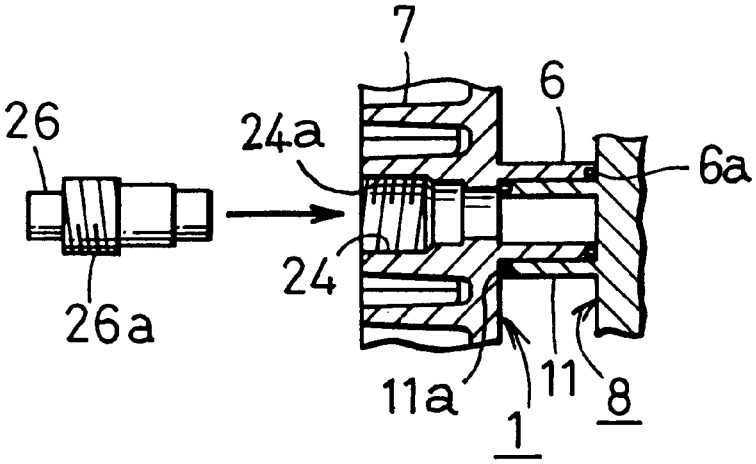
FIG. 5 is a vertical sectional view taken along the line IV—IV in FIG. 2 before mounting a closure member.

The low-pressure-side outlets 23, 24 are selectively closed by closure members 26 depending on the condition of use as shown in FIGS. 4 and 5. For example, when it is used at frequency of 50 Hz, the first low-pressure-side outlet 23 opens and the second low-pressure-side outlet 24 is closed by a closure member 26. When it is used at frequency of 60 Hz, the second low-pressure-side outlet 24 opens and the first low-pressure-side outlet 23 is closed by a closure member 26.

One of the low-pressure-side outlets 23, 24, which opens, Is connected to an entrance of an intermediate cooler 28 for cooling a pressurized gas, and the high-pressure-side inlet 25 is connected to an exit of the intermediate cooler 28 via a conduit 29.

As shown in FIG. 5, the closure member 26 has an external thread 26*a* which is engaged in an internal thread 24*a* of the low-pressure-side outlet 23, 24 to close the outlets 23, 24 completely. The closure member 26 can be engaged in low-pressure-side outlets 23, 24 without removing the stationary plate 5 from the outside of the scroll compressor. The external thread 26*a* of the closure member 26 has the same shape as a mounting portion of the conduit 27 connected to each of the low-pressure outlets 23, 24.

Figure 6:
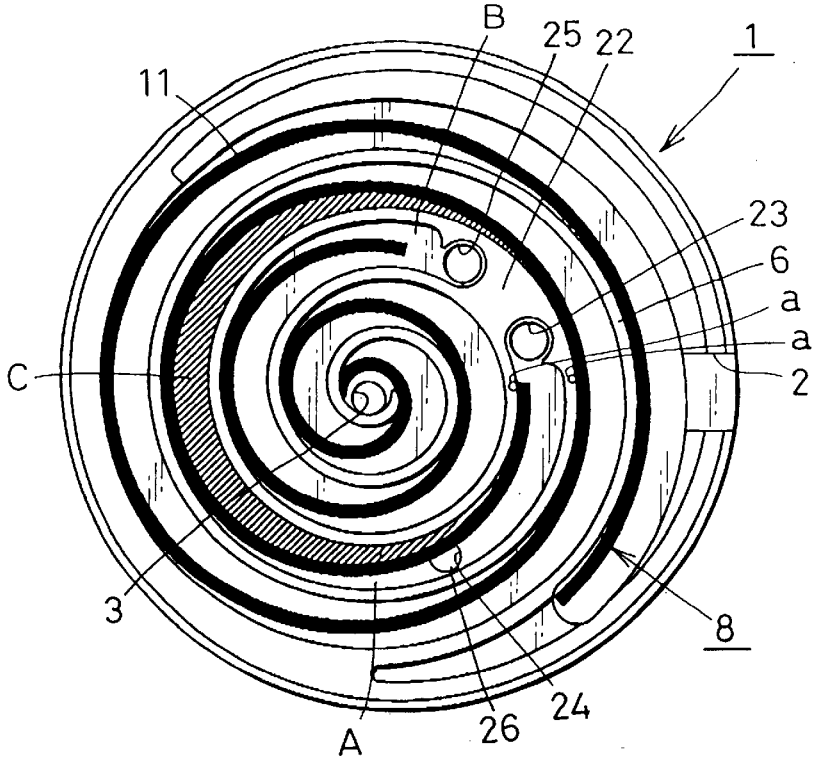
FIG. 6 is a view showing operation of a compression chamber that is formed when the second low-pressure-side outlet is closed.

FIG. 6 shows that the second low-pressure outlet 24 is closed, and FIG. 7*b* shows that the first low-pressure-side outlet 23 is closed, relating to FIG. 2.

When frequency of an alternating voltage applied to a motor is 50 Hz, the conduit 27 connected to the intermediate cooler 28 is connected to the first low-pressure-side outlet 23, and the second low-pressure-side outlet 24 is closed by the closure member 26. Thus, by revolving the orbiting scroll 8 by the motor, air taken in through the inlet 2 of the stationary scroll 1 is compressed gradually by a compression chamber formed between the stationary wrap 6 and the orbiting wrap 11 of the low pressure pressurizing portion "A", and moved in an anti-clockwise direction or towards the center in FIG. 6.

Air taken in through the inlet 2 is compressed to an amount corresponding to a volume of the compression chamber "C" formed between sealing points "a" and "a" at which the stationary wrap 6 contacts the orbiting wrap 11, and discharged through the first low-pressure-side outlet 23 at the innermost winding of the low-pressure pressurizing portion "A". After compression heat generated by compression is cooled by the intermediate cooler 28, the air is sent from the high-pressure-side inlet 25 to the high-pressure pressurizing portion "B", further compressed in the high-pressure pressurizing portion "B", and finally discharged through the outlet 3 to an air tank.

Figure 7:
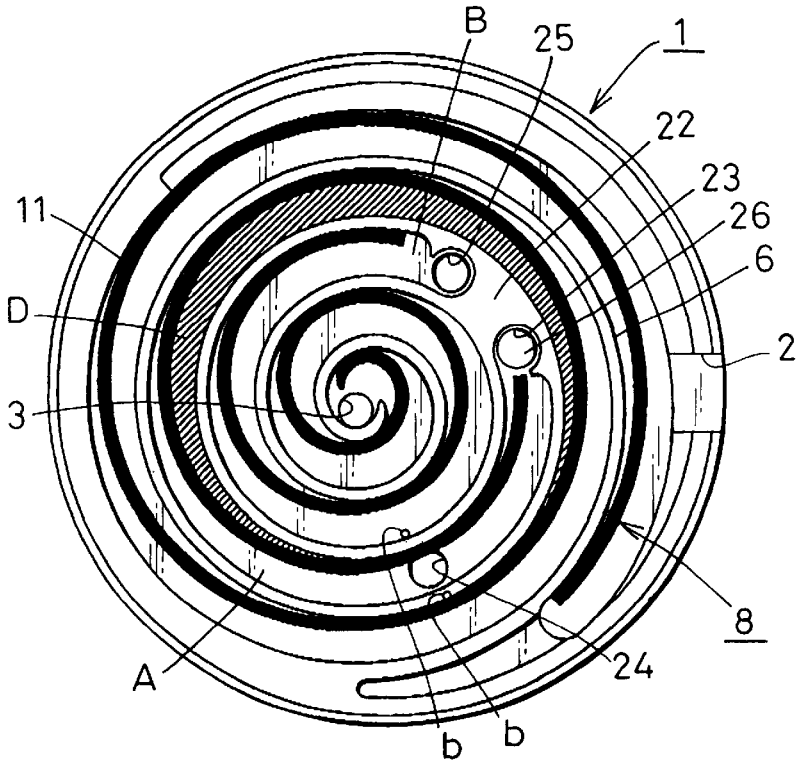
FIG. 7 is a view showing operation of the compression chamber that is formed when the first low-pressure-side outlet is closed.

When the frequency is 60 Hz, the conduit 27 is connected to the second low-pressure outlet 24 and the first low-pressure outlet is closed by the closure member 26. Thus, air taken in through the inlet 2 is compressed only to an amount corresponding to a volume of a compression chamber "D" that provides more volume than that of the compression chamber "C" as shown in FIG. 7 to reduce compression ratio compared with the operation of 50 Hz, thereby preventing overload even if the number of rotation of an AC electric motor becomes higher. That is to say, when the first low-pressure-side outlet 23 is closed, a sealing point "b" at which the stationary wrap 6 contacts the orbiting wrap 11 is outer than the sealing points "a", "a", the volume of the compression chamber "D" formed between the sealing points "b", "b" becomes larger than the volume of the compression chamber "C" to reduce a compression ratio.

Figure 8:
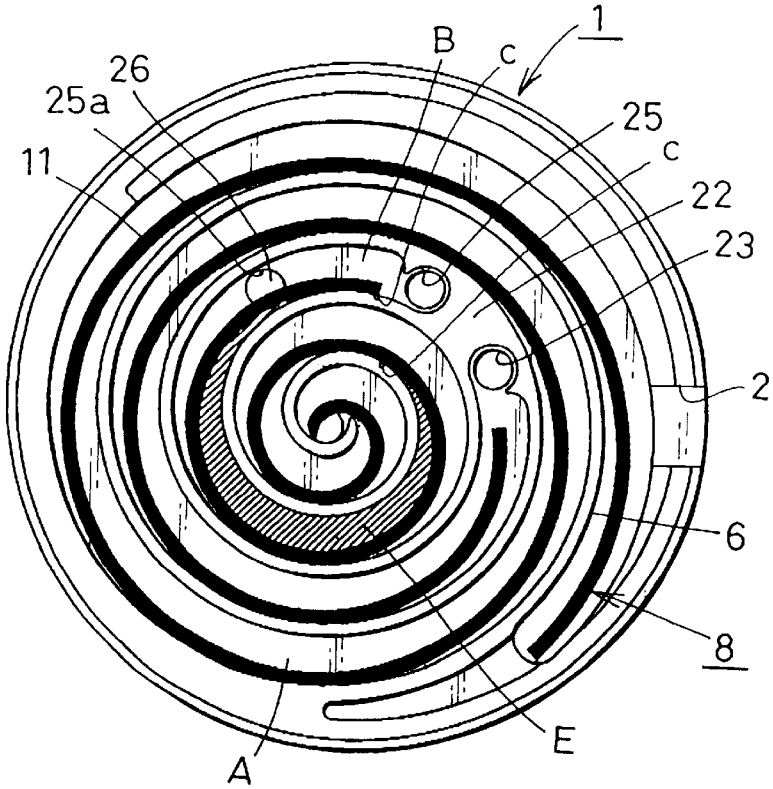
FIG. 8 is a view showing operation of a compression chamber that is formed when the other high-pressure-side inlet is closed in another embodiment.
Figure 9:
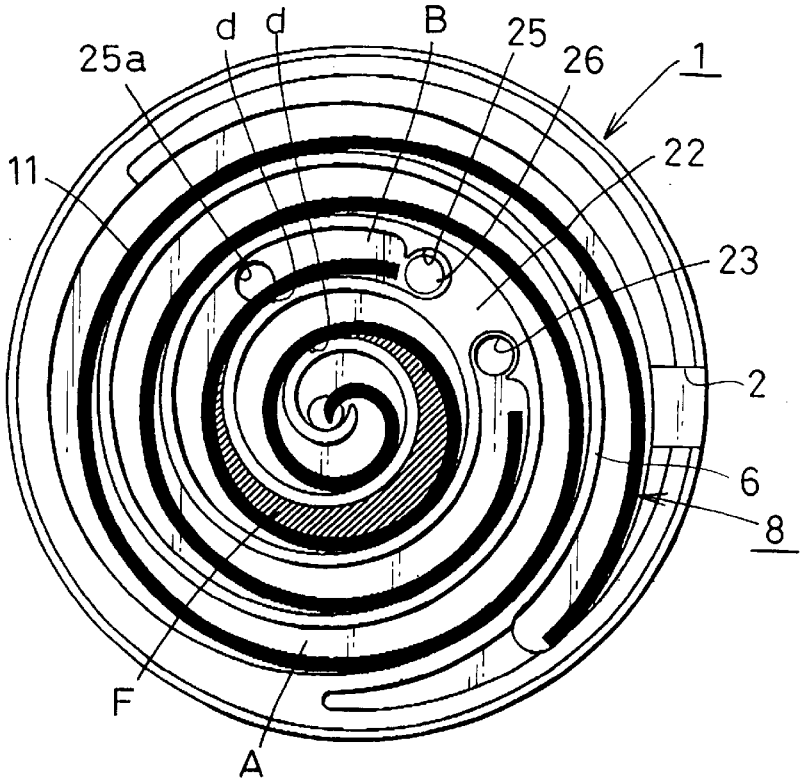
FIG. 9 is a view showing operation of a compression chamber that is formed when the high-pressure-side inlet is closed.

FIGS. 8 and 9 show the second embodiment of the present invention. In the embodiment, a single low-pressure-side outlet 23 is formed in a low-pressure pressurizing portion "A", and there are formed a high-pressure-side inlet 25 by an insulating wall 22 and another high-pressure-side inlet 25*a* inner than the inlet 25.

When frequency is 50 Hz, a conduit 29 is connected to the high-pressure-side inlet 25, and the other high-pressure-side inlet 25*a* is closed by a closure member 26. When frequency is 60 Hz, the conduit 29 is connected to the high-pressure-side inlet 25*a*, the high-pressure-side inlet 25 is closed by the closure member 26.

Therefore, when the frequency is 50 Hz, compressed air discharged through the low-pressure-side outlet 23 is sent to a high-pressure pressurizing portion "B" through the high-pressure-side inlet 25. As shown in FIG. 8, the air is gradually compressed by a compression chamber "E" formed between sealing points "c" and "c" at which the stationary scroll 6 contacts the orbiting scroll 1 in the high-pressure pressurizing portion "B", moved in an anti-clockwise direction or towards the center and discharged through the outlet 3.

When the frequency is 60 Hz, compressed air discharged from the low-pressure-side outlet 23 is sent into the high-pressure pressurizing portion "B" through the high-pressure-side inlet 25*a*. As shown in FIG. 9, the air is gradually compressed by a compression chamber "F" formed between sealing points "d" and "d" at which the stationary wrap 6 contacts the orbiting wrap 11 in the high-pressure pressurizing portion "B", moved in an anti-clockwise direction or towards the center and discharged through the outlet 3. In this case, the compression chamber "F" is inner than the compression chamber "E", the volume of the compression chamber "F" becomes smaller than the volume of the compression chamber "E", and the amount of the air taken into the high-pressure pressurizing portion "B" becomes smaller, thereby reducing compression ratio and preventing overload even if the number of rotation of an AC electric motor becomes higher.

In the foregoing embodiments, the present invention is applied to a single-winding multi-stage scroll compressor in which the low-pressure pressurizing portion "A" is separated from the high-pressure pressurizing portion "B", but may be applied to a single-winding single-stage scroll compressor in which a low-pressure pressurizing portion "A" and a high-pressure pressurizing portion "B" are continuously formed.

In this case, without low-pressure-side outlet or high-pressure-side inlet, another outlet is formed outer than the outlet 2. In case of 50 Hz, the outlet 2 is connected to an air tank and the other outlet is closed by a closure member 26. In case of 60 Hz, the other outlet is connected to an air tank, and the outlet 2 is closed by a closure member 26.

The present invention is applied not only to a scroll compressor, but also to any other scroll-type fluid machines. The invention can be also applied to an oil-filling scroll-type fluid machine as well as the oil-free scroll-type fluid machine as above.

According to the present invention, compression ratio is changeable depending on the condition of use. Overloading can be prevented without replacement of parts.

The foregoing merely relates to embodiments of the invention. Various modifications and changes may be made by a person skilled in the art without departing from the scope of claims wherein:

What is claimed is:

1. A scroll-type fluid machine comprising:

a housing;

a stationary scroll fixed to the housing and having an outer inlet, a plurality of inner outlets and a spiral stationary wrap on one side face, at least one of the inner outlets being able to be closed by a closure member;

an orbiting scroll connected to a drive shaft to be able to revolve with respect to the stationary scroll, a spiral orbiting wrap facing the stationary wrap of the stationary scroll to form a compression chamber between the stationary wrap and the orbiting wrap, a low-pressure pressurizing portion that is formed at an outer side of said stationary wrap and said orbiting wrap; said low-pressure pressurizing portion having said outer inlet and said plurality of inner outlets; and a high pressure pressurizing portion that is formed at an inner side of said stationary wrap and said orbiting wrap, said low-pressure pressurizing portion being separated from said inner high-pressure pressurizing portion, a gas pressurized in said low-pressure pressurizing portion being discharged through at least one of said plurality of inner outlets of said low-pressure pressurizing portion and introduced into said high-pressure pressurizing portion through a high-pressure-side inlet of said high-pressure pressurizing portion for further pressurizing.

2. A scroll-type fluid machine comprising:

a housing;

a stationary scroll fixed to the housing and having a plurality of outer inlets, an inner outlet and a spiral stationary wrap on one side face, at least one of the outer inlets being able to be closed by a closure member;

an orbiting scroll connected to a drive shaft to be able to revolve with respect to the stationary scroll, a spiral orbiting wrap facing the stationary wrap of the stationary scroll to form a compression chamber between the stationary wrap and the orbiting wrap, a low-pressure pressurizing portion that is formed at an outer side of said stationary wrap and said orbiting wrap; and a high pressure pressurizing portion that is formed at an inner side of said stationary wrap and said orbiting wrap, said high-pressure pressurizing portion having said plurality of outer inlets and said inner outlet, said low-pressure pressurizing portion being separated from said inner high-pressure pressurizing portion, a gas pressurized in said low-pressure pressurizing portion being discharged through a low-pressure-side outlet of said low-pressure pressurizing portion and introduced into said high-pressure pressurizing portion through at least one of said plurality of outer inlets of said high-pressure pressurizing portion for further pressurizing.

* * * * *